US006781318B2

(12) United States Patent
Lapatovich et al.

(10) Patent No.: US 6,781,318 B2
(45) Date of Patent: Aug. 24, 2004

(54) PAR LAMP WITH REDUCED LAMP SEAL TEMPERATURE

(75) Inventors: Walter P. Lapatovich, Boxford, MA (US); Richard Snellgrove, Danvers, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/120,958

(22) Filed: Apr. 11, 2002

(65) Prior Publication Data

US 2003/0193280 A1 Oct. 16, 2003

(51) Int. Cl.[7] ..... H01J 13/32

(52) U.S. Cl. ..... 315/113; 315/77; 313/493; 313/495

(58) Field of Search ..... 315/77, 113; 313/493, 313/495, 496, 113; 362/255, 293, 343

(56) References Cited

U.S. PATENT DOCUMENTS 5,220,235 A * 6/1993 Wakimizu et al. ..... 313/112
5,353,210 A * 10/1994 Strok et al. ..... 362/293
6,356,700 B1 * 3/2002 Strobl ..... 385/147

* cited by examiner

*Primary Examiner*—James Vannucci
*Assistant Examiner*—Jimmy T. Vu
(74) *Attorney, Agent, or Firm*—William E. Meyer

(57) ABSTRACT

The neck of a typical PAR lamp tends to focus the light issued in the neck or heel of the lamp back onto the lamp seals. The focused lost light then tends to overheat the seal and shorten lamp life. A practical solution is to intercept this lost light with a light absorbing layer. The light is then converted to heat in the layer. The heat is then re-radiated in an unfocused fashion with only a small portion of it redirected to the seal area. The interception layer may be formed as a black top coating on the neck interior or the neck exterior if the reflector is otherwise light transmissive. Alternatively, the neck may be formed from a translucent or opaque material that then converts the light into heat in the body of the reflector wall. The neck is then specifically not metallized so as to reflect light from the internal neck surface back to the lamp seal.

15 Claims, 3 Drawing Sheets

PAR LAMP WITH REDUCED LAMP SEAL TEMPERATURE

1. TECHNICAL FIELD

The invention relates to electric lamps and particularly to electric lamps enclosed in a reflector. More particularly the invention is concerned with a reflector lamp (PAR) with a ceramic metal halide lamp capsule with a reduced lamp capsule seal temperature.

2. BACKGROUND ART

Ceramic lamp envelopes with modern metal halide seals have developed a new class of metal halide lamps (Geven et. al. in U.S. Pat. No. 5,424,609 and by Carleton et. al. in J. Ill. Eng. Soc. P139–145, Winter 1996 (Proc. Of IESNA Annual Conference)). These lamps contain metal halide fill chemistries, and two electrodes. A high voltage pulse between the electrodes is used to ignite the lamp. Normal current and voltage is then applied through the electrodes to excite the enclosed gas and fill materials to a plasma state. Typical fills include rare earth halides with various other additives including thallium halide and calcium halide, in addition to an inert starting gas such as argon or xenon.

The ceramic arc tube is often jacketed in another envelope, called an outer jacket, to protect the inner arc tube from the air. Many of the lamp parts, especially niobium electrical in-leads, oxidize rapidly if exposed to air at the lamp operating temperatures, causing the lamp to fail. These outer jackets are usually thermally isolated from the arc tube by construction and contain a vacuum or are filled with a partial pressure of an inert gas and a better material, for example a zirconium and aluminum compound, to better oxygen and hydrogen.

Often the inner arc tube and outer jacket are mounted inside a parabolic reflector (PAR or PAR lamp) to gather and direct the generated light from the lamp in a useful beam pattern. This can be a flood or a spot beam for illumination of interior surfaces or building facades in exterior applications. Such lamps with halogen light sources are also commonly used for illuminating merchandise in stores and outside lighting in residential applications, for example security lighting. There is great interest in using the ceramic metal halide lamps in the applications cited since they are efficient and provide excellent color rendering. The true colors or merchandise are rendered almost as if they were displayed in sunlight.

Economies of scale dictate using the same reflector for the new ceramic metal halide lamps (HCI lamps) as were originally used for halogen lamps. This keeps manufacturing costs to a minimum. It is also allows the lamps to be used in existing the fixtures.

Unfortunately, life tests have shown that the HCI lamps mounted in existing lamp structures fail prematurely at about 1500–2000 hours, instead of the rated 10,000 hours. This is attributed to the rapid chemical attack by the fill material on the sealing glass (frit) used to make the conventional HCI seals (see Geven et. al. in U.S. Pat. No. 5,424,609). The problem is exacerbated when the lamps are run in the base up configuration (base towards ceiling), as they are in many interior down lighting applications. The seal is then subject to greater heat and therefore more active chemical reaction. To be a useful product in the markets mentioned, the lifetime of the lamp must be extended.

SUMMARY OF THE INVENTION

A PAR lamp with an HID light source may achieve improved life by including a light absorbing layer in the neck of the reflector. An HID light source having two sealed electrodes defining a lamp axis is preferred. A concave ceramic shell is formed having an internal surface with a reflective surface. The shell further has a neck defining a neck cavity and a reflector axis. The neck is provided with an electrical connection and a mechanical support for the light source. The shell is positioned to surround the source and thereby reflect light from the source to a field to be illuminated during lamp operation. The light source and reflector are oriented with the lamp axis to be substantially co-axial with the reflector axis, with at least a portion of at least one of the electrodes extending in the neck cavity. A substantially non-transmissive, light absorbing layer that intercepts light from the source emitted in the direction of the neck is positioned in the neck to absorb light that might otherwise be reflected back onto the lamp seal region.

DETAILED DESCRIPTION OF THE INVENTION

Figure 1:
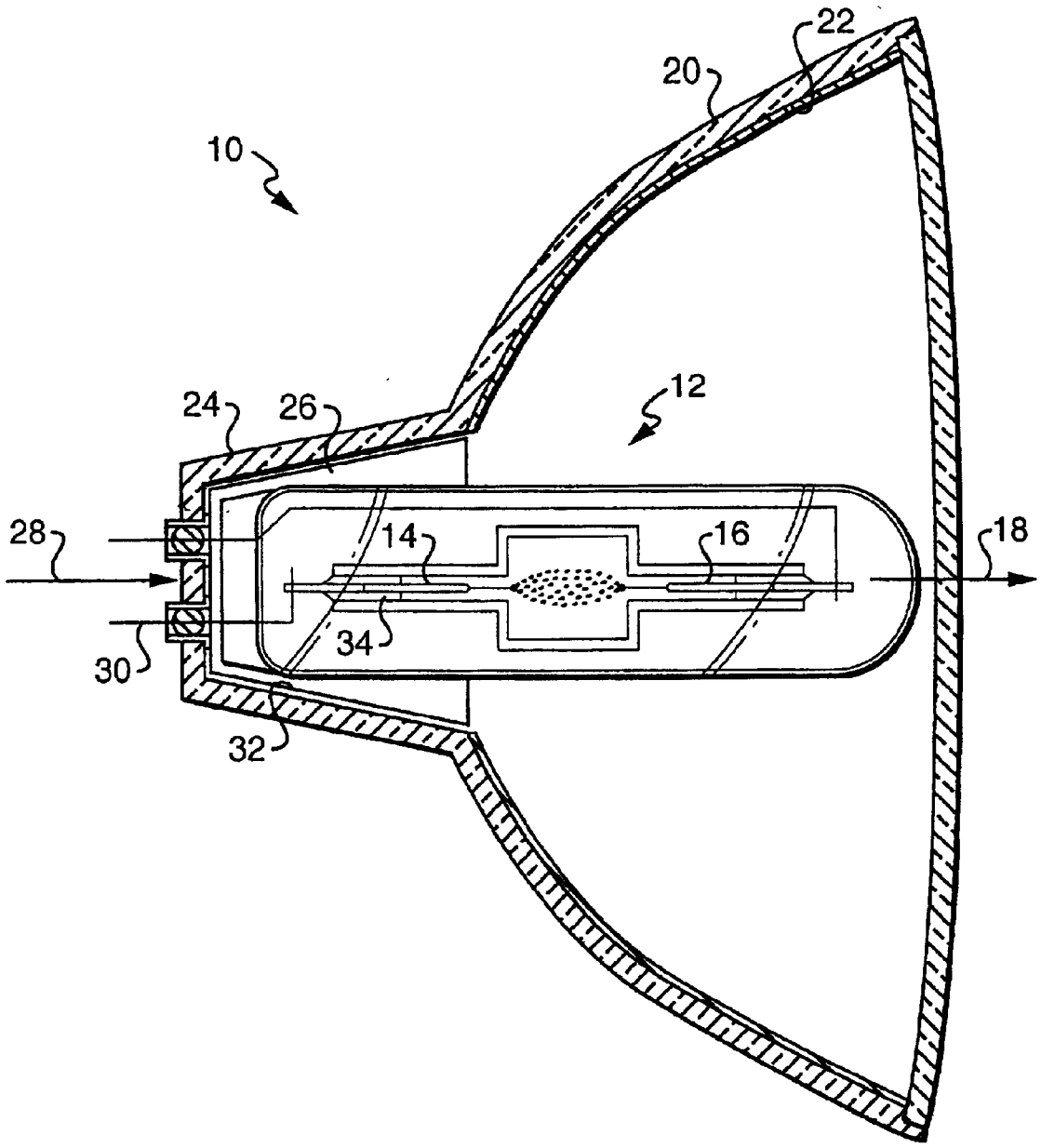
FIG. 1 shows a schematic cross-sectional view of a preferred embodiment of a lamp assembly with an internal black top coating.

FIG. 1 shows a schematic cross-sectional view of a preferred embodiment of a lamp assembly with an internal light absorbing coating. The preferred PAR lamp assembly 10 comprises a light source 12 having two sealed electrodes 14, 16 defining a lamp axis 18; a concave ceramic shell 20 having an internal reflective surface 22. The shell 20 further has a neck 24 defining a neck cavity 26 and a reflector axis 28. The neck 24 is provided with an electrical connection 30 and a mechanical support for the light source 12. The shell 20 surrounds the light source 12 to reflect light from the light source 12 to a field to be illuminated during lamp operation. The preferred light source 12 and reflector 20 are oriented with the lamp axis 18 to be substantially co-axial with the reflector axis 28, and at least a portion of at least one of the electrodes 14, 16 extends in the neck cavity 26, and a region with a substantially non-transmissive, light absorbing layer 32. FIG. 1 shows the light source 12 being offset from the neck 24 by an oven gay, the neck cavity 26, between the light source 12 and the neck 24.

The light source 12 may be any light source, although the value comes from protecting a particularly hot light source such as a high intensity discharge (HID) light source held in an outer jacket. The preferred light source is double ended and has with a first electrode 14 extending approximately axially with respect to the light source axis 20, and a similar second electrode 16 similarly extending axially from the light source. The first electrode 14, and second electrode 16 then define a lamp axis 18. Typical double-ended high intensity discharge lamps are made from quartz, hard glass or ceramic and are tubular in shape. Ceramic lamps are of particular interest here, but the concept can be applied to other lamps also.

The concave ceramic shell 20 has an internal reflective surface 22 formed thereon, for example an aluminization or dichroic coated layer. The preferred reflector is a body of revolution about a reflector axis 28. The reflector may have a parabolic, elliptical or similarly prescribed surface that may be smooth, faceted or otherwise shaped to reflect light from the light source 12 in preferred directions, to yield a desired beam pattern. The shell 20 further extends from the region of the reflective surface 22 towards a narrower neck 24 defining a neck cavity 26. The neck 24 is provided with an electrical connection or connections 30 for powering the light source, and a mechanical support or supports, which may be the same as the electrical connections. The mechanical supports hold the light source 12 in a preferred position relative to the shell 20. The light source 12 generally faces the reflective surface 22 so that light from the light source 12 is reflected to a field to be illuminated during lamp operation. The preferred light source 12 and reflector 20 are oriented along the lamp axis 18 to be substantially co-axial with the reflector axis 28. At least a portion of the sealed lead for one of the electrodes, for example the sealed lead for electrode 14, extends in the neck cavity 26, in the lamp seal region 34.

In a first embodiment, a substantially non-transmissive, light absorbing layer 32 is positioned in the neck 24, surrounding the sealed region 34. The non-transmitting layer 32 may comprise a light absorbing coating formed on the interior of the neck 24. For example a black topping type material may be painted on the neck interior. In this embodiment the black topping layer is usually sufficiently irregular that any reflection or radiation from the surface is diffused, and not focused on the lamp seal region 34.

Figure 2:
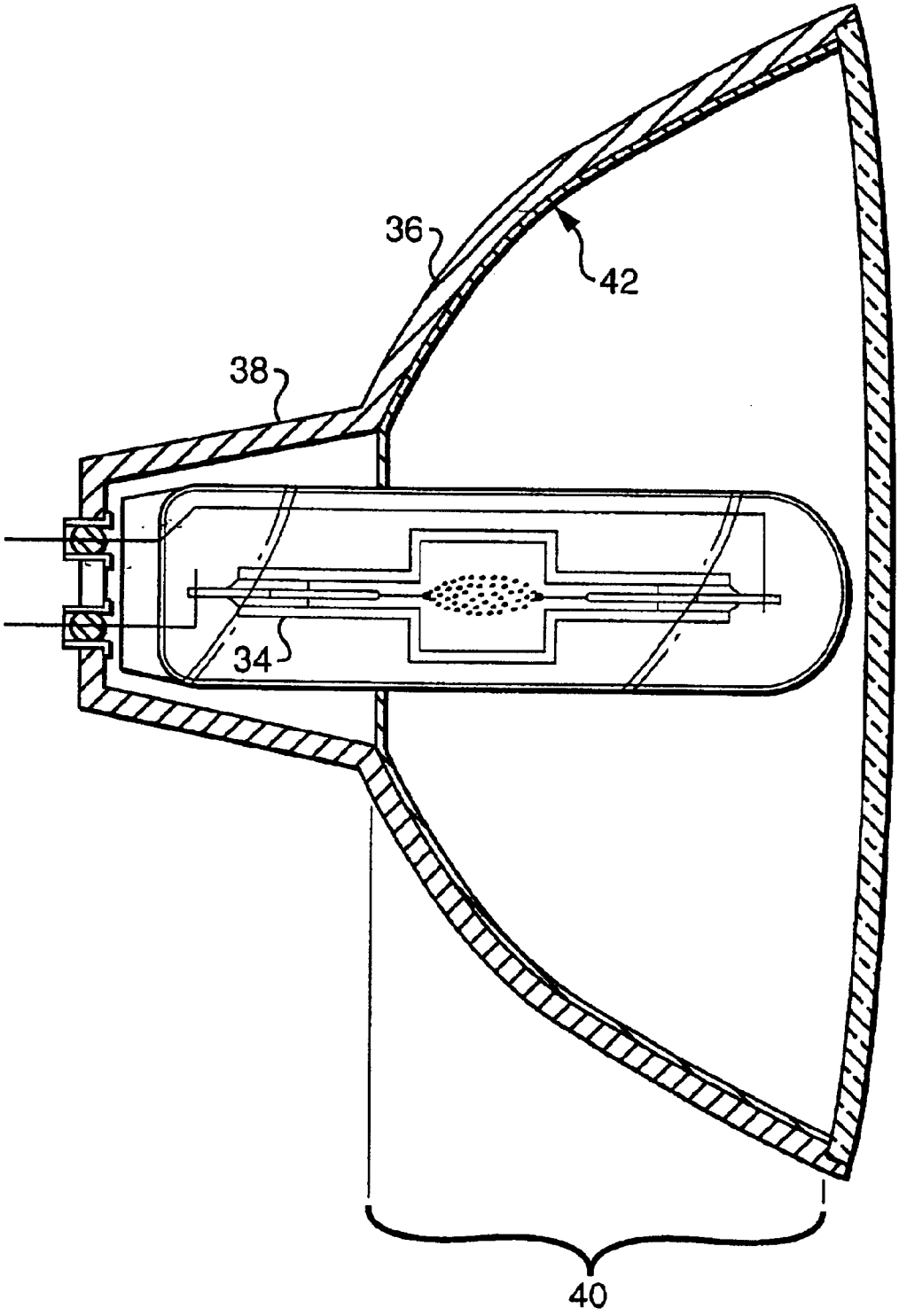
FIG. 2 shows a schematic cross-sectional view of a preferred embodiment of a lamp assembly with a light absorbing shell material.

In a second, embodiment, the reflector 36, or at least the neck 38, is formed from a non-transmitting material, such as an opaque glass. FIG. 2 shows a schematic cross-sectional view of a preferred embodiment of a lamp assembly with a light absorbing reflector material. FIG. 2 also shows the light source being offset from the neck by an open gap, the neck cavity, between the light source and the neck. It is practical to make the whole reflector 36 from an opaque glass. The entire glass reflector substrate may be dyed or impregnated with ions to alter the absorption of light so that the glass in the neck becomes opaque to visible light. No absorptive coating need not then be applied to the neck. The opaque glass itself acts as an absorptive layer. The opaque reflector 32 is then coated in the reflective region 40 with a reflective layer 42, such as a metallization or dichroic layer, while the neck 38 is uncoated. Removal of any excess reflective coating from the neck interior may be necessary. The light projected into in the neck cavity is then substantially absorbed by the non-transmitting glass, and converted to heat internally in the glass. In this embodiment there may be some focused reflection onto the seal region 34, if the neck 38 has a smooth interior surface. This surface reflection may be reduced by roughening the interior neck surface, for example by selective sand blasting or chemically etching the neck interior.

Figure 3:
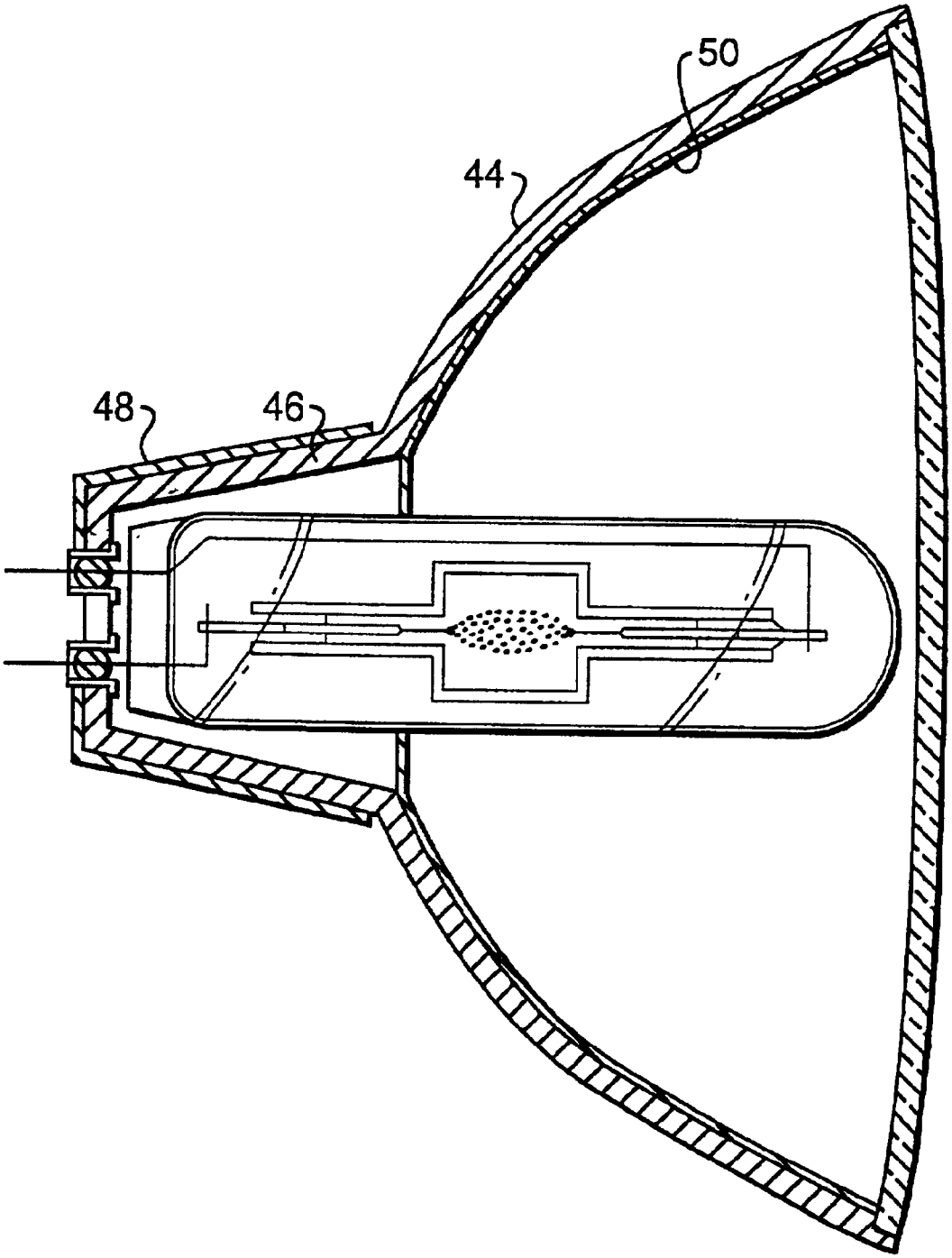
FIG. 3 shows a schematic cross-sectional view of a preferred embodiment of a lamp assembly with an external black top coating.

In a third embodiment, the exterior surface of a light transmissive reflector shell 44, is coated along the neck 46 exterior with a light absorbing material, such as a black topping material, to form a light absorbing layer 48. FIG. 3 shows a schematic cross-sectional view of a preferred embodiment of a lamp assembly with an external light absorbing 48 coating on the neck 46. FIG. 3 also shows the light source being offset from the neck by an open gap, the neck cavity, between the light source and the neck. In this embodiment there may be reflections from either the first or second surfaces of the light transmissive reflector in the neck. These surface reflections may again be reduced by roughening either or both the first and the second surface of the light transmissive reflector in the neck 46. In this embodiment the reflective coating 50 does not extend into interior the neck 46.

Once the reflector is prepared, for example aluminized and then coated with absorptive material, the reflector (20, 36, or 44) is then combined in a final lamp assembly in much the same way as a standard reflector. Eyelets may be located in the heel of the neck to duct the leads through the reflector which are then soldered in pace. A threaded brass, bayonnet, bi-pin type or similar base (not shown) may be glued or similarly attached or formed on the exterior of the reflector as is known in the art. Several commercial cements are available, for example Aremco, Sauereisen, etc. are well known to those skilled in the art. To ensure good adhesion to the glass, the absorptive coating is masked from those regions where the cement is needed to form a bond between the glass of the reflector and the base. Alternatively, the typical brass base can be peened in position with the indentations of the brass conforming to intentionally positioned cavities or protuberances formed on the exterior of the reflector. This process is also well known to those skilled in the art. The leads are electrically coupled through the reflector to the attached base for subsequent electric coupling to power the light source, also as is known in the art.

A lens may or may not be attached to the forward edge of the reflector lip to enclose the light source in the reflector cavity. The lens may be melt fused, glued, or similarly coupled through an intermediary support to the reflector as known in the art.

In one embodiment the reflector had a diameter of 95.25 millimeters and an axial extension of 88 millimeters. The neck had an opening diameter of 21 millimeters and an axial extension of 35 millimeters. The neck interior was coated with a silicon based blacktop material (Aremco) and cured to a hard surface. The black top coating had a deep gray or black color, and a diffuse surface. The coated reflector was then assembled as similar lamps with the insertion of a 70 watt, double ended, press sealed high intensity discharge lamp tube with a diameter of 8.6 millimeters and a length of 38 millimeters. This left a gap of 6.2 millimeters between the lamp tube and the reflector neck opening. The HID lamp had a sealed lamp lead that extended approximately 14 millimeters away from the enclosed volume for the discharge. The outer diameter of the jacket was approximately 15 millimeters; the overall length was about 65 millimeters. The HID lamp was installed co-axially with a reflector with one end of the sealed leads for one of the electrodes extended in the neck. The lamp was positioned in the reflector so the center of the ceramic arc tube was approximately coincident with the reflector center (focal point) of the reflector. This was approximately 32 millimeters from the base end of the lamp outer jacket. Light rays from the discharge maintained between the electrode tips can be traced to the reflective surfaces. Calculations show the light rays reflected from the neck region would normally impinge on the seal region, thereby heating the seal region. A fraction of this reflected radiation would be absorbed in the seal elevating its temperature and causing premature lamp failure. The light rays that propagate in the neck would be lost eventually turning into heat after multiple reflections and would not contribute usefully to the beam output. The lumen output with or without the blacktop was found to be approximately the same. Without the coating, normally about 3700 lumens were directed to the field for illumination. With the coating, about 3700 lumens were also directed to the field for illumination, suggesting that a large portion of the light entering the neck region is wasted being substantially turned into heat. The temperature of the inner lamp capsule's seal region was measured. Without the light absorbing layer, the temperature of the seal region was found to be approximately 1012 degrees Celsius, (1854 degrees Fahrenheit). With the light absorbing layer, (black topping) the temperature of the seal region was found to be about approximately 875 degrees Celsius, (1607 degrees Fahrenheit). Clearly the light absorbing layer (black topping) was substantially lowering of the temperature of the seal region. A lower seal temperature is known to extend the life of this type of lamp.

Other measurements were made on lamps before mounting in the reflector and subsequent to mounting in the reflector. The lost light, that is the light impinging on the neck and that did not exit the lens on the first bounce, amounted to approximately 40 percent of the luminous output of the jacketed, inner lamp. Even a small portion of this light absorbed on the seal area would elevate the seal temperature to an unacceptable level.

Tests were done with an automotive blacktop compound normally used for halogen headlamp manufacturing, although any type of opaque absorptive paint may be used. Such blacktop compound may consist for example of an emulsion of kaolin clay, silicon powder, aluminum phosphate and water, for example, silicon blacktop from Aremco Products, Inc. Valley Cottage, N.Y., which cures to a durable coating upon baking. Other formulations may contain silicon, carbon and iron powders with butanol and glycerin as organic binders. An alternative black top coating may be high temperature black paint sold for repairing barbecue grills and capable of 315 degrees Celsius (600 degrees Fahrenheit) continuous operation, for example Krylon BBQ and Stove paint, Sherwin Williams, Cleveland, Ohio.

The reflective coating tested was aluminum, however a multilayer dichroic coating or another high reflectivity metal such as silver, titanium or others could be used instead. The use of high reflective coatings for the manufacture of high quality reflectors is well known to those skilled in the art.

Various lamp structures were tested to determine their effectiveness in reducing the seal temperature. The temperature differences for enclosed lamps were compared that of a bare arc tube. Lamps were enclosed in unmodified, and modified reflectors and had outer jackets that were vacuum or nitrogen filled. Filling the outer jacket with nitrogen cools the seal area, but also cools the rest of the arc lamp resulting in an undesirable color shift in the lamp output. Even with nitrogen, the lamp inside the reflectors ran too hot. For testing, small slots were drilled in the reflectors to permit infrared imaging of the arc tubes during operation. Test lamps were operated with and without lenses, with and without reflective coatings, and with and without absorptive coatings. The seal temperature of the 70 watt ceramic lamp in an evacuated jacket with no reflector and no lens, and burning base up in air was used as a base temperature. The 70 watt lamp in an evacuated jacket placed in a reflector with a lens had a seal temperature 159 degrees Celsius above the base temperature. The 70 watt lamp in an evacuated jacket placed in a reflector with a lens, but with no reflective coating in the neck area and a black absorptive coating on the exterior of the neck area had a seal temperature, only 23 degrees Celsius above the base temperature. The black coating reduced the seal temperature by about 136 degrees Celsius. A similar lamp with a 400 torr nitrogen fill in the outer jacket, not enclosed by a reflector and lens had a temperature 72 degrees Celsius below the base line. The nitrogen filled outer jacket lamp when enclosed in a reflector and lens as before had a seal temperature 120 degrees Celsius above the base temperature. The nitrogen filled outer jacket lamp when enclosed in a reflector and lens, but with the reflective material removed and black coated as before had a seal temperature 12 degrees Celsius below the base temperature. The results show that the ceramic lamp with the reflective coating removed and black coated in the neck area, and otherwise operated in accordance with the invention, reduced the seal area temperature by approximately 132 to 136 degrees Celsius (237 to 244 degrees Fahrenheit). This is a surprisingly high temperature difference and its reduction is expected to increase lamp life by a factor of four. The determination of the exact reference temperature is approximate due to uncertainties in infrared transmittances, reflectance and emittance of the surfaces between source and detector. The change in temperature as the lamp environment changed is more important as to the effectiveness of the present invention.

The preferred embodiment with both the reflective coating removed in the neck and the absorptive coating applied on the neck exterior, permit the lamp to operate with only a slightly elevated seal area temperature as compared to a bare arc tube. Since a bare arc tube lasts about 10,000 hours, a lamp in a vacuum outer jacket along with the modified reflector is expected to have a similar lifetime.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A PAR lamp assembly comprising:

a light source having two staled electrodes defining a lamp axis;

a concave ceramic shell having an internal surface with a reflective surface formed thereon, the shell further having a neck defining a neck cavity and a reflector axis, the neck provided with an electrical connection and mechanical support for the source, the shell surrounding the source to reflect light from the source to a field to be illuminated during lamp operation, the source and reflector being oriented with the lamp axis to be substantially co-axial with the reflector axis, and at least a portion of at least one of the electrodes extending in the neck cavity, at least one sealed lead for at said least one electrode extending in the cavity neck being offset by an open gap between said at least one sealed lead for said at least one electrode extending in the cavity neck and the neck, and a substantially non-transmissive, light absorbing layer formed on the neck at least in a region adjacent the open gap, intercepting light from the source emitted in the direction of the neck.

2. The lamp assembly in claim 1, wherein the light absorbing layer is coated on the interior surface of the shell in the neck.

3. The lamp assembly in claim 1, wherein the shell is formed from a light transmissive material and the light absorbing layer is coated on an exterior surface of the shell adjacent the neck.

4. The lamp assembly in claim 1, wherein the shell, at least in the neck, is formed from a substantially light absorbing material thereby forming the light absorbing layer, and is substantially not coated by a reflective layer in the neck interior.

5. The lamp assembly in claim 1, wherein the light absorbing layer is a black top material.

6. The lamp in claim 1, wherein the reflector is formed from a translucent glass.

7. The lamp in claim 4, wherein the reflector is formed from an opaque glass.

8. The lamp in claim 1, wherein the reflective layer is an aluminization layer.

9. The lamp in claim 1, wherein the reflective layer is a dichroic coating layer.

10. The lamp in claim 1, wherein the shell is a body of revolution about the reflector axis.

11. The lamp in claim 1, wherein the source is further enclosed by a lamp jacket.

12. The lamp in claim 1, where in the shell is closed by a lens positioned intermediate the reflective surface and the field illuminated by the lamp during lamp operation.

13. The lamp in claim 1, wherein the light source is a high intensity discharge source.

14. The lamp in claim 13, wherein the light source is a doubled ended source with a first axial electrode stem and a second axial electrode stem, and at least one of the electrode stems is located substantially co-axially with the reflector axis in the neck cavity.

15. The lamp in claim 1, wherein the source is a ceramic metal halide high intensity discharge lamp.

* * * * *